US005255741A

United States Patent [19]

Alexander

[11] Patent Number: 5,255,741

[45] Date of Patent: Oct. 26, 1993

[54] PROCESS AND APPARATUS FOR COMPLETING A WELL IN AN UNCONSOLIDATED FORMATION

[75] Inventor: Steve L. Alexander, Bakersfield, Calif.

[73] Assignee: Mobil Oil Corporation, Fairfax, Va.

[21] Appl. No.: 806,056

[22] Filed: Dec. 11, 1991

[51] Int. Cl.[5] ..... E21B 7/20; E21B 10/32; E21B 10/34; E21B 43/04

[52] U.S. Cl. ..... 166/278; 166/51; 175/267

[58] Field of Search ..... 166/51, 278; 175/267, 175/276, 314, 69, 317

[56] References Cited

U.S. PATENT DOCUMENTS

| | | | |
|---|---|---|---|
| 3,817,339 | 6/1974 | Eurse | 175/271 |
| 3,833,071 | 9/1974 | Koosman et al. | 175/323 X |
| 4,031,972 | 6/1977 | Burg | 175/263 |
| 4,091,883 | 5/1978 | Weber | 175/287 |
| 4,253,522 | 3/1981 | Setterberg, Jr. | 166/51 X |
| 4,282,941 | 8/1981 | Perkin | 175/267 |
| 4,401,158 | 8/1983 | Spencer et al. | 166/51 |
| 4,519,451 | 5/1985 | Gray et al. | 166/51 X |
| 4,565,252 | 1/1986 | Campbell et al. | 175/269 |
| 4,628,993 | 12/1986 | Zunkel | 166/51 |
| 4,660,657 | 4/1987 | Eurse et al. | 175/269 |
| 4,846,290 | 7/1989 | Jones | 175/269 |
| 4,865,128 | 9/1989 | Dickinson | 166/51 X |
| 5,040,601 | 8/1981 | Karlsson et al. | 166/387 X |
| 5,074,366 | 12/1991 | Karlsson et al. | 175/267 X |

OTHER PUBLICATIONS

Liner Drill-in Tools (1 page) Designed for drilling-in liners with foam or other drilling fluids. Chancellor, Inc. Dec., 1989.

Liner Drill-in and Gravel Pack Method (1 page) Chancellor, Inc. Dec. 1989.

Foam Gravel Packing pp. 10–13 SPE Production Engineering Feb. 1990.

*Primary Examiner*—George A. Suchfield

*Attorney, Agent, or Firm*—Alexander J. McKillop; George W. Hager, Jr.; Michael J. Mlotkowski

[57] ABSTRACT

A process and apparatus for forming a hole within an unconsolidated hydrocarbonaceous fluid-bearing formation, installing a slotted liner and gravel packing the liner in a single trip into the formation. The apparatus includes a drill bit for drilling a pilot hole; a housing mounted above the pilot hole drill bit; means for enlarging a pilot hole, the pilot hole -enlarging means pivotally mounted within the housing and capable of pivoting between a retracted position and an expanded position for enlarging a pilot hole to a diameter larger than the pilot hole and sufficient for gravel packing; a slotted liner having a first end and a second end, the first end joined to the apparatus above the housing; and a drive assembly joined to the second end of the slotted liner.

20 Claims, 7 Drawing Sheets

PROCESS AND APPARATUS FOR COMPLETING A WELL IN AN UNCONSOLIDATED FORMATION

FIELD OF THE INVENTION

The present invention relates to the production of subterranean fluids and, in particular, to a process and apparatus for completing a well in an unconsolidated hydrocarbon-bearing formation.

BACKGROUND OF THE INVENTION

To recover valuable fluids from subterranean formations, wells are drilled from the surface of the earth to the productive formations. In the drilling of such wells, a rotating drill bit is commonly employed. As the bit rotates, penetrating through to the formation, material is dislodged in the form of cuttings. These cuttings are commonly removed from the well during the drilling operation by means of a drilling fluid, which may be comprise water, oil, an emulsion of water and oil or foam. The drilling fluid is circulated downward through the drill pipe and upward through the annulus between the drill pipe and the wall of the well, carrying the cuttings with it to the surface of the well in the form of a slurry. The drilling fluid also serves to cool the drill bit and can prevent blow-outs when drilling into strata containing high pressure fluids. When drilling a well, it is common to start with a relatively large diameter hole and cement surface casing in the hole. Subsequent drilling operations are then conducted through this casing. As drilling progresses deeper into the well, the diameter of the hole drilled may be reduced in steps, with progressively smaller diameters of casing employed in response thereto.

In seeking to recover hydrocarbon-bearing fluids from subterranean formations, it is often the case that such fluids are found to reside within formations which are unconsolidated. Unconsolidated formations often comprise poorly cemented sandstone which have little or no cementing material holding the grains of sand together. The production of hydrocarbons from unconsolidated formations often results in the concomitant production of sand. As those skilled in the art readily appreciate, the production of sand is undesirable for many reasons, chief among these being that it is abrasive to the components within the well, such as tubing, pumps, valves and the like, causing rapid erosion of such equipment and, in addition, may result in the partial or complete blockage of the well. Sand production is often rate sensitive, that is, no sand may be produced at very low rates of production, while at higher rates, large amounts of sand may be produced.

A variety of techniques have been employed to control the flow of sand from unconsolidated formations. Many of these techniques employ the use of slotted or screened liners or gravel packs to prevent the sand from being transported along with the hydrocarbons into the well. For example, in the heavy oil sands of California, well completions generally employ slotted liners. Typically, the slotted liner is drilled into the producing zone of the formation with foam, to a predetermined depth. Advantages accruing from the use of foamed-in liner completions include: reduced drilling expense, increased production and the bio-degradability typical of such foams. However, these well completions, without being gravel packed across the unconsolidated producing zone, experience higher operational costs due to produced formation sand.

In certain situations, when attempting to install a gravel packed liner in an unconsolidated formation, a variety of problems can be encountered. One such problem arises when attempting to underream a drilled pilot hole with foam prior to gravel packing. As is often the case, when conducting a conventional underreaming operation, the underreamed hole will collapse before the liner is positioned for gravel packing due to the unconsolidated nature of the formation and the fact that the underreaming tool must be removed before the gravel pack is installed.

Underreamers are a type of borehole tool which is used to enlarge a borehole which has already been drilled. In an underreaming operation, an expandable drilling tool is introduced through the casing to the point where underreaming is to be conducted. There, the underreamer is expanded to drill the formation to a larger diameter than the hole through which the underreamer passed. A typical underreamer includes expandable arms mounted in a housing by hinge pins for movement between a closed position and an open, expanded position. In the usual case, the expandable arms are moved outwardly by means of a pressure activated piston mounted within the main bore of the tool's housing. Underreamers come in a variety of types. One type of underreamer employs rotatable cone bits, mounted on the ends of the expandable arms for engaging certain types of formation and is generally referred to as a roller cone underreamer. Another earlier type of underreamer is known as a drag bit underreamer. In the drag bit underreamer, the expandable arms have a machined surface which is typically coated with a hard facing material for engaging and enlarging a borehole after the initial hole has been cut. The machined surface may have diamond bit implants such as those manufactured by General Electric under the trademark "Stratapax". As is known in the art, underreamers may be mounted at the end of the drill string or, in the case of a drilling type underreamer, mounted in the drill string ahead of the drill bit.

Despite these advances in the art, there exists a need for an apparatus and method capable of placing a liner and gravel pack in an unconsolidated formation in a single trip into the well.

SUMMARY OF THE INVENTION

In accordance with the present invention, there is provided a process for forming a hole within an unconsolidated hydrocarbonaceous fluid-bearing formation, installing a slotted liner and gravel packing the liner in a single trip into the formation. The process includes the steps of: drilling a bore hole to a first predetermined depth above the hydrocarbonaceous fluid producing zone; installing a well casing in the bore hole to about the first predetermined depth; lowering on a pipe string through the bore hole an apparatus for drilling and installing a slotted liner to be gravel packed, the apparatus including a drill bit for drilling a pilot hole, means for enlarging the pilot hole to a diameter larger than the internal diameter of the well casing and sufficient for gravel packing, the pilot hole enlarging means being initially retracted and located within a housing above the pilot hole drill bit, a slotted liner having a first end and a second end, the first end integrally joined to the apparatus above the housing and a drive assembly joined to the second end of the slotted liner; rotating the apparatus to drill a pilot hole through the hydrocarbonaceous fluid producing zone; expanding the initially retracted pilot hole enlarging means upon exceeding the first pre-determined depth; enlarging the pilot hole to a diameter larger than the internal diameter of the well casing and sufficient for gravel packing; continuing until the first end of the slotted liner reaches a second pre- determined depth, the second pre-determined depth sufficient to place the slotted liner within the hydrocarbonaceous fluid producing zone; reversing the direction of circulation down an annulus defined by the well casing and drill pipe and injecting a gravel slurry through the drill pipe and into an annulus defined by the enlarged hole and slotted liner to gravel pack the annulus.

Also provided is an apparatus for drilling and installing a slotted liner and gravel packing the liner in a single trip into an unconsolidated hydrocarbonaceous fluid-bearing formation. The apparatus includes a drill bit for drilling a pilot hole; a housing mounted above the pilot hole drill bit; means for enlarging a pilot hole, the pilot hole enlarging means pivotally mounted within the housing and capable of pivoting between a retracted position and an expanded position for enlarging the pilot hole to a diameter larger than the pilot hole and sufficient for gravel packing; a slotted liner having a first end and a second end, the first end joined to the apparatus above the underreaming bit housing; and a drive assembly joined to the second end of the slotted liner.

Therefore it is an object of the present invention to provide an improved process for forming a pilot hole, enlarging the pilot hole to a diameter larger than the pilot hole and the internal diameter of the well casing, installing a gravel pack within an unconsolidated hydrocarbonaceous fluid-bearing formation.

It is another object of the present invention to provide a process for forming a pilot hole, enlarging the pilot hole to a diameter larger than the pilot hole and the internal diameter of the well casing, and installing a slotted liner and gravel packing the slotted liner in a single trip into the well.

It is a further object of the present invention to provide an apparatus for drilling and installing a slotted liner for gravel packing.

Other objects and the several advantages of the present invention will become apparent to those skilled in the art upon a reading of the specification and the claims appended thereto.

BRIEF DESCRIPTION OF THE DRAWINGS

Reference may now be had to the following detailed description of exemplary embodiments of the invention, taken in conjunction with the accompanying drawings, in which.

DETAILED DESCRIPTION OF THE INVENTION

The present invention is beet understood by reference to the appended figures, which are given by way of example and not of limitation.

Figure 1:
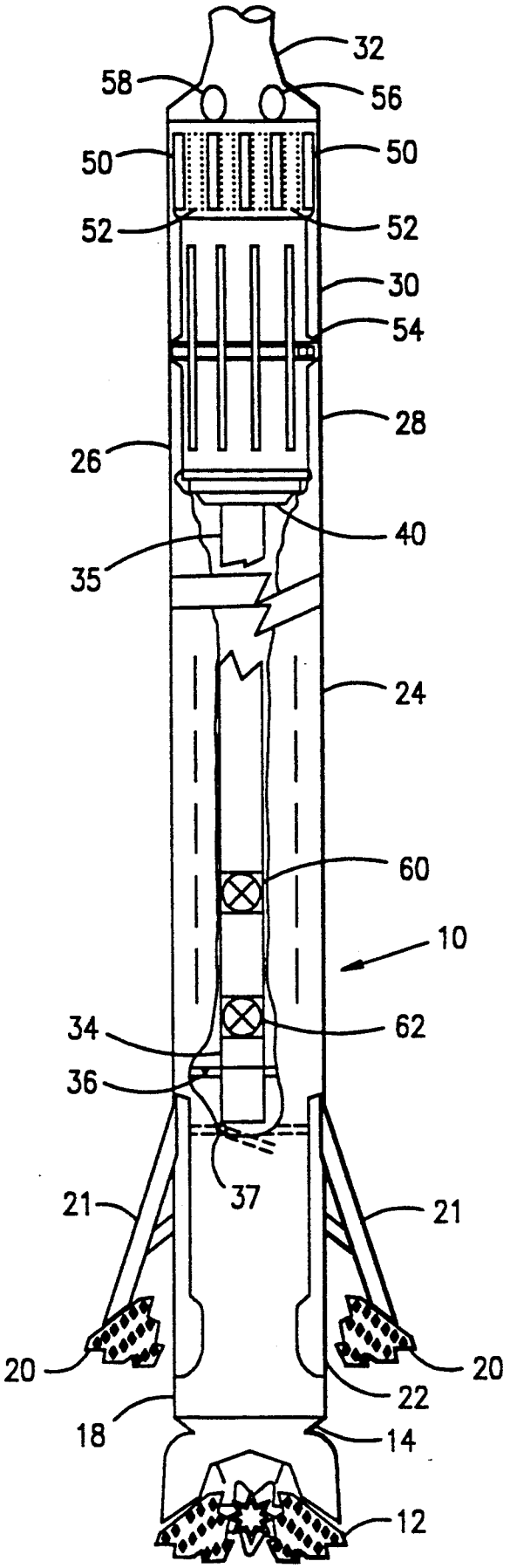
FIG. 1 presents an apparatus for drilling and installing a slotted liner for gravel packing, in accordance with the present invention, showing two roller cone-type underreaming bits.

Referring now to FIG. 1, an apparatus 10 for drilling and installing a gravel-packed liner is shown, in accordance with the present invention. Apparatus 10 includes a drill bit 12 for drilling a pilot hole, drill bit 12 attached to the bottom of bit shank 14. Apparatus 10 employs a seal bore and check valve assembly 36 and 37 to allow a tubing tail 34 to pass through to conduct drilling fluid circulation through the bit 12. As those skilled in the art appreciate, a wide variety of drilling fluids are known and readily available. Included among those drilling fluids suitable for use in the practice of the present invention are aqueous-based polymeric solutions, filtered water and preformed foams. Particularly preferred in many applications are the foam-based drilling fluids. Welded to the top of bit shank 14 is housing 18. Housing 18 serves to at least partially enclose a pilot hole enlarging means, which in the embodiment depicted in FIGS. 1 and 2 is a pair of roller-cone underreaming bits 20. While a pair of roller cone underreaming bits are shown in the embodiment of FIGS. 1 and 2, it is to be understood that one, two, three or more roller cone underreaming bits 20 may be effectively used in apparatus 10 in order to enlarge the pilot hole drilled by bit 12. The use of two roller cone underreaming bits 20 is particularly preferred in the practice of the present invention. Roller cone underreaming bits 20 are affixed at the ends of bit arms 21, bit arms 21 used to expand and retract roller cone bits 20, as may be easily envisioned. Roller-cone underreaming bits 20 enter housing 18 through slots 22 when the roller-cone underreaming bits 20 are in the initially retracted position. When in the expanded position, roller-cone underreaming bits 20 are employed to enlarge a pilot hole to a diameter sufficient for gravel packing.

Welded to the top of housing 18 is a slotted production liner 24 having a length appropriate for the particular production zone sought to be gravel packed. On top of the slotted liner 24 is a drive assembly 26 which may be welded to the slotted liner 24, as preferred, to allow liner rotation while drilling. Drive assembly 26 also permits the installation of a sand control packoff assembly (see FIGS. 2A–D) after the slotted liner 24 is set at its desired depth. Drive assembly 26 includes drill-in nipple 28 to which is attached drive tool 30 which consists of drill pipe assembly 40, collet release 54, splines 50 and 52, and circulation ports 56 and 58, each of which is described in more detail below. Drive assembly 26, itself, is affixed to drill pipe 32. Splines 50 are provided on drive tool 30 for mating engagement with splines 52 of drive assembly 26. A collet release 54 is provided which enables the liner to be released off of after gravel packing is complete. Circulation ports 56 and 58 are provided for use during the clean-up operation.

Still referring to FIG. 1, it may be seen that a tubing tail 34 with expansion joint 35 runs from the crossover of drill pipe assembly 40 down through the length of apparatus 10. Drill pipe assembly 40 is comprised of tubing tail 34, an upper end of which is attached to expansion joint 35. The upper end of expansion joint 35 is welded or screwed onto a right-hand threaded nut (not shown) which is provided for mating with an internal threaded portion of drill-in nipple 28. Tubing tail 34 is also provided with an upper sleeve valve 60 and a lower sleeve valve 62 for use in controlling fluid flow during circulation and clean-up, as will be described in more detail below.

Figure 2A:
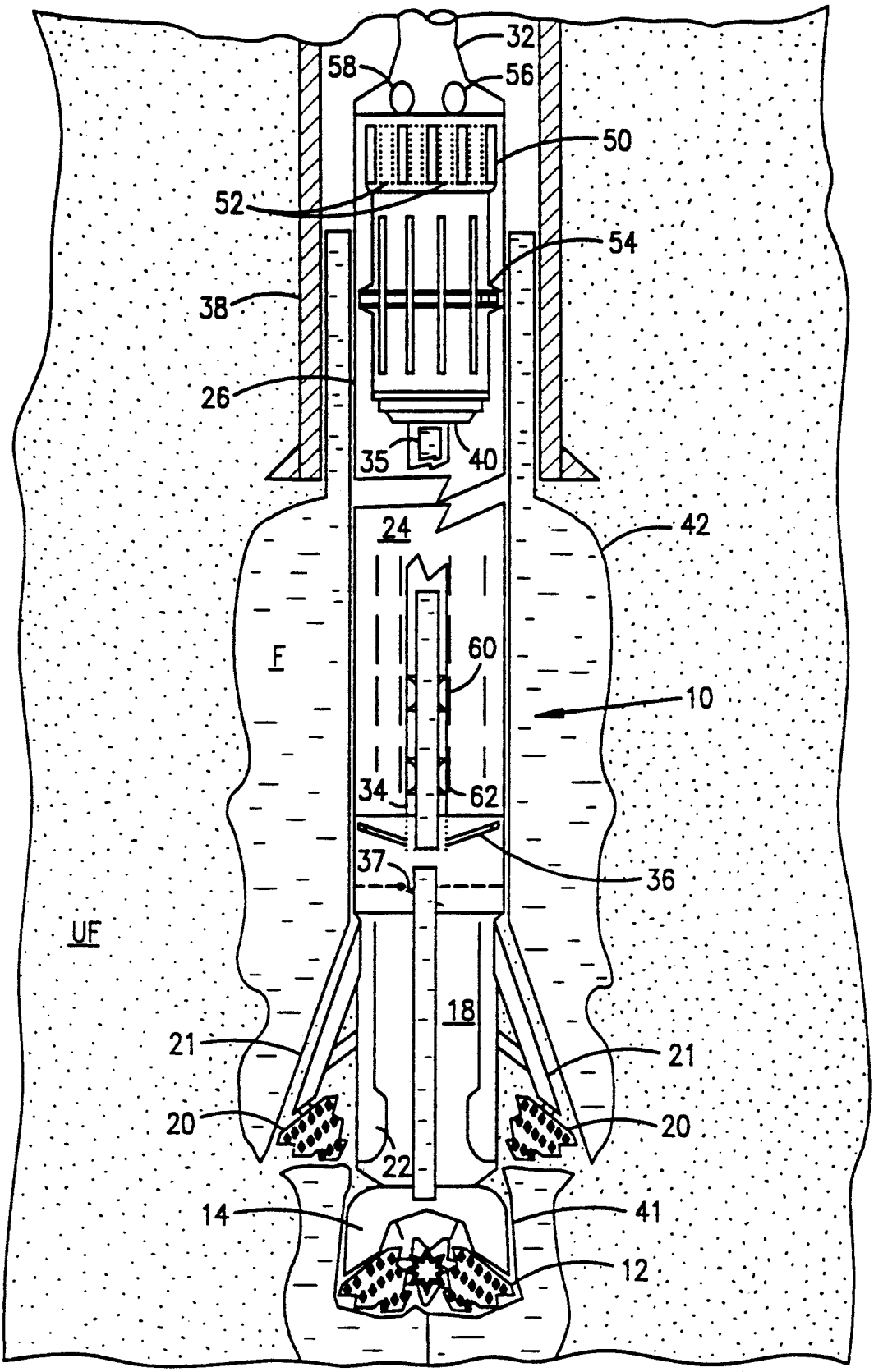
FIGS. 2A–D show the apparatus of FIG. 1 within an unconsolidated formation, in partial cut-away, at various stages of the process of the present invention.

FIGS. 2A–D show the apparatus 10 of FIG. 1 placed within an unconsolidated formation at various stages of the process of the present invention. Referring now to FIG. 2A, apparatus 10 is shown, in partial cut-away, positioned just at its final depth within an unconsolidated formation UF. Surface casing 38 is shown set to the top of formation UF and cemented in place, as is customary. Apparatus 10 is shown with underreamer roller cone bits 20 in the expanded condition, with liner 24 having been drilled-in with foam F and pilot hole 41 underreamed to form annulus 42. Slotted liner 24 is shown in partial cut-away to expose a portion of tubing tail 34 and flexible seal 36. As shown, upper and lower sleeve valves 60 and 62, respectively, are in the closed condition, enabling the foam F to circulate out drill bit 12.

Figure 2B:
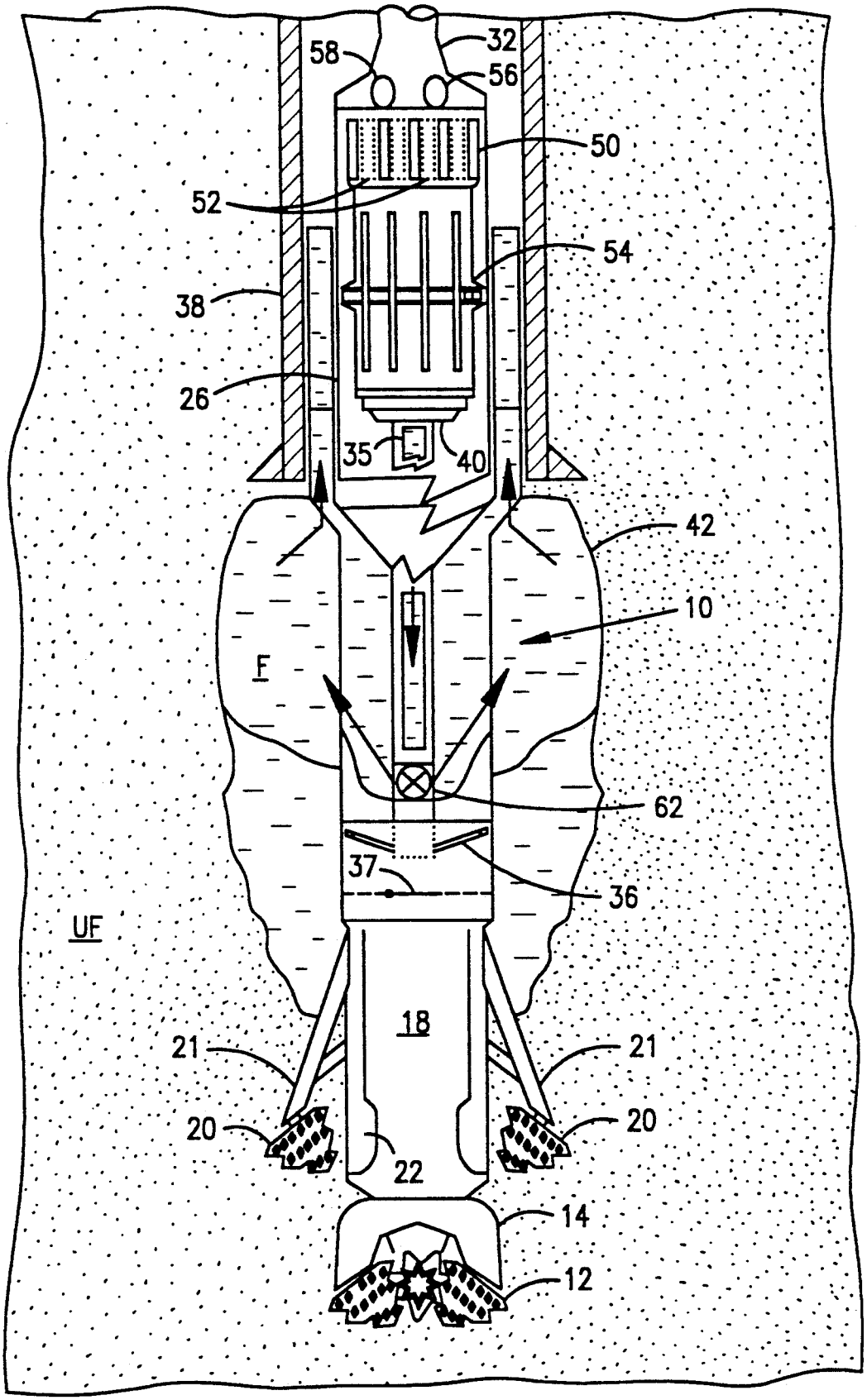

Referring now to FIG. 2B, apparatus 10 is shown, after the liner drill-in process is completed, with liner slot clean-up in progress. As may be seen, lower sliding sleeve valve 62 is in the open position and check valve 37 is in the closed position, permitting flow out lower sliding sleeve valve 62, through the interior of slotted liner 24, out through its slots and up through the annulus 42, the arrows indicated the direction of flow. Also, as shown, the remaining portion of pilot hole 41 and the lowermost portion of annulus 42 will close-up around the expendable underreamer roller cone bits 20, housing 18 and pilot hole bit 12, as is desired.

In operation, a small diameter ball (about 1.25") is dropped and pumped down the drill pipe 32, through the tubing tail 34, and seated in lower sliding sleeve valve 62. Hydraulic foam pressure is then applied to open lower sliding sleeve valve 62. Foam is then pumped down the drill pipe 32, tubing tail 34, and out the open lower sliding sleeve valve 62 to displace any fill (formation sand) that may be present above the sliding sleeve valve 62 and inside slotted liner 24. Foam is then circulated to the surface for a short period of time. In the event that circulation is not established through sliding sleeve 62, a larger ball (about 1.5" in diameter) would be dropped in the same manner to open the upper sleeve valve 60 to achieve clean-up. Upper sleeve valve 60 may be placed at any desired depth between the expansion joint 35 and the lower sliding sleeve valve 62.

Once clean foam returns are established, the direction of foam circulation is reversed with foam circulated down the drill pipe casing annulus (see FIG. 2C), with clean foam passing through the lower sliding sleeve valve 62, up the tubing tail 34 and drill pipe 32 to the surface.

Figure 2C:
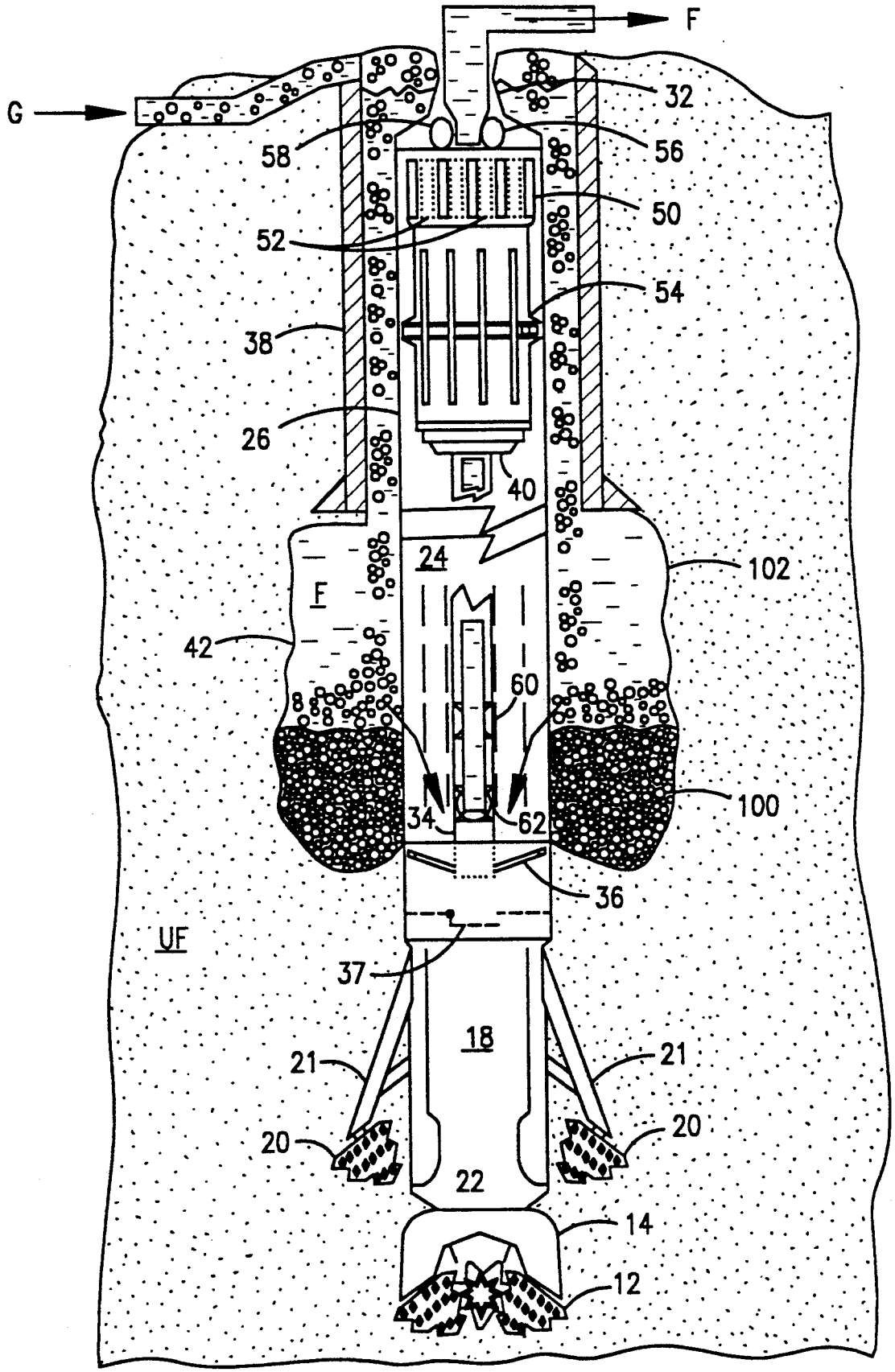

FIG. 2C depicts apparatus 10, in partial cut-away, during gravel packing. Gravel-laden foam G is fed over the top and down through the annulus formed between apparatus 10 and casing 38, into underreamed annulus 42. Annulus 42 is shown having a fully packed section 100 and section 102 where packing is still progressing. Lower sleeve valve 62 is in the open position, with check valve 37 in the closed position, permitting foam F to flow into liner 24 through its slots and into lower sleeve valve 62, up through tubing tail 34 and out through the top of apparatus 10, as indicated by the arrows.

Figure 2D:
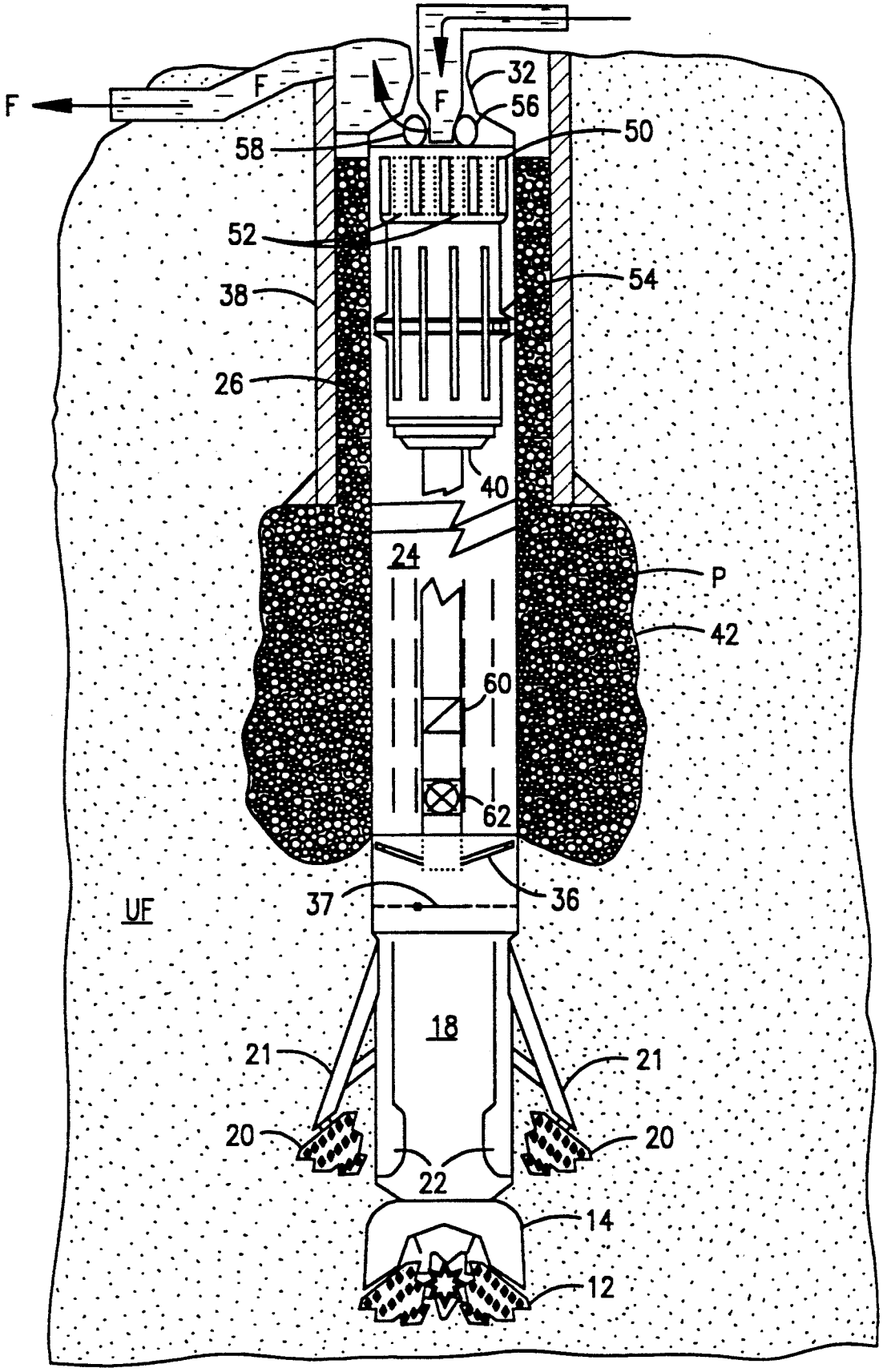

FIG. 2D shows apparatus 10, in partial cut-away, following the completion of the gravel packing step. Gravel pack P is shown fully completed and the slotted liner 24 released from drill-in nipple 28. Foam is circulated down into drill pipe 32, out through circulation ports 56 and 58 and out of the drill pipe casing annulus until clean foam exits the hole. Tubing tail 34 is then unstrung from apparatus 10 and removed. A sand control pack-off assembly, not shown, is then driven over the top of the drill-in nipple 28.

Figure 3:
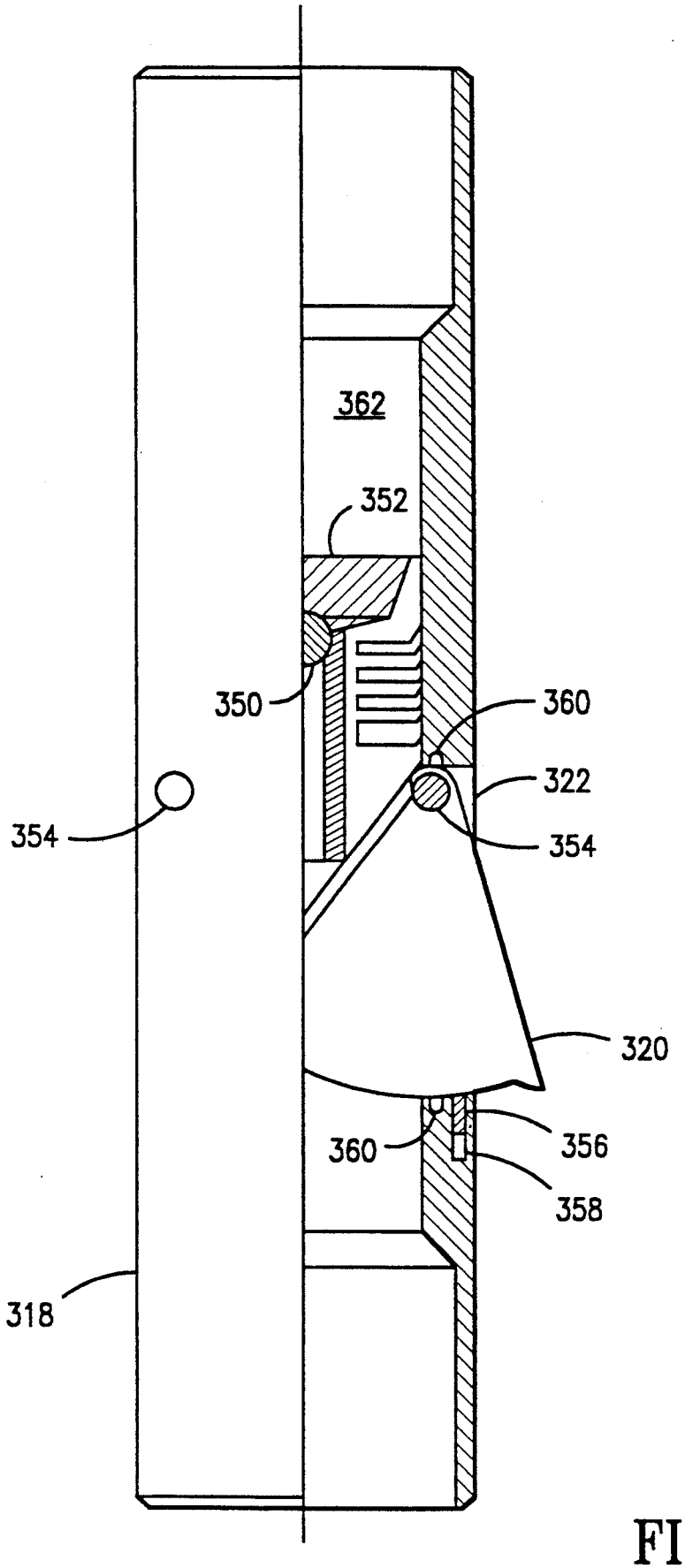
FIG. 3 presents an alternate means for enlarging a pilot hole including two drag-type underreaming blades, shown in the retracted position and a preferred mechanism for expanding the drag blades.

FIG. 3 presents an alternate means for enlarging a pilot hole for use in an apparatus for drilling and installing a gravel-packed liner 10, in accordance with the present invention. As shown, the means for enlarging a pilot hole employs a pair of underreaming drag blades 320, depicted in the partially expanded position. While a pair of underreaming drag blades are shown in FIG. 3, it is to be understood that one, two, three or more drag blades 320 may be effectively used to enlarge the pilot hole drilled by bit 12. The use of two drag blades 320 is particularly preferred in the practice of the present invention. As with the previously described embodiment of the present invention, when in the expanded position, underreaming drag blades 320 are employed to enlarge a pilot hole to a diameter sufficient for gravel packing.

Figure 4:
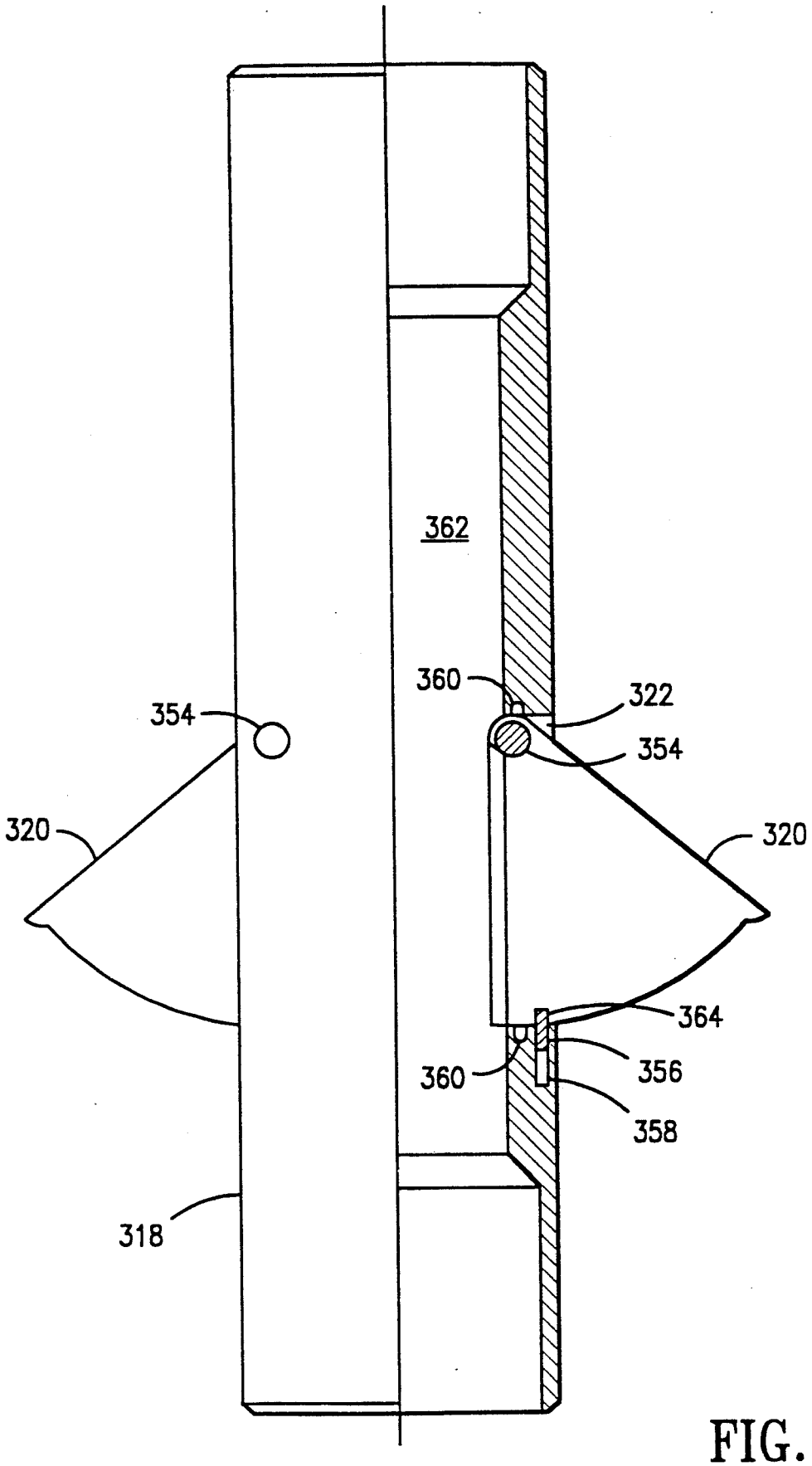
FIG. 4 shows the mechanism of FIG. 3 with the drag blades locked in the fully expanded position.

Referring to the cut-away portion of FIG. 3, a preferred mechanism for expanding drag blades 320 is shown in schematic form. In operation, once housing 318 has reached the point at which underreaming is to be conducted, the underreamer drag blades 320 are expanded by the application of drilling fluid pressure and by hydraulically sliding a plunger 352 through the internal passageway 362 of housing 318 while rotating the apparatus, forcing drag-blades 320 out of slots 322 of housing 318. (As indicated above, particularly preferred are the foam-based drilling fluids). Drag blades 320 are locked open by the use of a shear pin 356, which may be loaded by spring 358 or by any suitable means (e.g. hydraulic pressure). Referring to FIG. 4, drag-blades 320 are shown locked in the expanded position by the interaction of spring-loaded shear pin 356 with key-way 364 of drag-blades 320. Once the drag-blades are placed in the expanded and locked position,.plunger 352 can be pumped down into a fluted assembly above the pilot hole drill bit by dropping a ball of about one inch in diameter, thus establishing a passage for circulation.

The following specific example is presented herein to illustrate particular embodiments of the present invention and hence is illustrative of this invention and not to be construed in a limiting sense.

EXAMPLE

This example demonstrates the ability of the apparatus and process of the present invention to foam-drill a gravel-packed liner completion in a single trip into the well, utilizing underreaming.

Prior to beginning the completion process, surface casing was set to the top of a selected formation and cemented. A service rig complete with blow-out equipment, foaming unit and power swivel was then rigged up on the well. The casing float collar and casing shoe were drilled out in a conventional manner with water and circulated clean.

An apparatus in accordance with the present invention was used, the apparatus including a 7⅝" pilot hole drill bit welded to the bottom of the housing of the expendable underreamer. A seal bore with check valve to allow a tubing tail to pass through the liner joint to conduct all foam circulation out through the pilot hole bit was employed. An appropriate length of slotted production liner was welded to the top of the underreamer bit housing. On top of the slotted liner, a drive assembly is welded to the liner to allow liner rotation while drilling, permitting the installation of a sand control packoff assembly after the liner was set at desired depth. The complete liner and drill-in assembly was run into the well bore on drill pipe.

Once the hole opener has cleared the end of the casing the hole opener was expanded to 15". This was accomplished, as previously described, by hydraulically sliding a plunger through the hole opener while rotating the assembly, forcing the blades of the drag-type underreamer out. The blades of the underreamer were locked through the use of a shear pins. The liner was then foamed drilled and underreamed to the designated depth.

Once the desired depth was reached, the liner slots and underreamed hole were foamed clean for a short period of time. A small diameter ball (about 1.25") was dropped and pumped down the drill pipe, through the tubing tail, and seated in lower sliding sleeve valve. Hydraulic foam pressure was applied to open lower lit sliding sleeve valve. Foam was then pumped down the drill pipe, tubing tail, and out the open lower sliding sleeve valve to displace any fill (formation sand) that may have accumulated above the sliding sleeve valve and inside liner. Foam was then circulated to the surface for a short period of time.

As indicated above, in the event that circulation is not established through lower sliding sleeve valve, a larger ball (about 1.5" in diameter) would be dropped in the same manner to open the upper (back-up) sleeve valve to achieve the above described interior clean-up operation. Once clean foam returns are established, the direction of foam circulation is reversed with foam circulated down the drill pipe casing annulus, with clean foam returns through the upper sliding sleeve valve, up the tubing tail and drill pipe to the surface.

Gravel laden foam was pumped down the annulus defined by the casing and drill pipe to pack the open hole and liner annulus, with the drill pipe providing a return path for the gravel pack fluid, which, as indicated, was foam in this case. Upon completion of the gravel packing of the annulus, the liner was released and foam circulated through the circulation ports and out of the hole for clean-up. The tubing tail, liner drill-in assembly and drill pipe were then pulled out of the hole and a sand control pack-off assembly driven over the liner top for the completion of the well.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A process for installing a slotted liner and gravel pack within an unconsolidated hydrocarbonaceous fluid-bearing formation in a single trip into the formation, the formation having at least one hydrocarbonaceous fluid producing zone, the formation further having a bore hole drilled to a first pre-determined depth above the hydrocarbonaceous fluid producing zone and a well casing installed in the bore hole to about the first pre-determined depth, the well casing having an internal diameter, comprising the steps of:

(a) lowering on a pipe string through the bore hole an apparatus for drilling and installing a gravel-packed liner, the apparatus including a drill bit for drilling a pilot hole, means for enlarging the pilot hole to a diameter larger than the pilot hole and sufficient for gravel packing, the pilot hole enlarging means being initially retracted and located above the pilot hole drill bit, a slotted liner having a first end and a second end, the first end joined to the apparatus above the pilot hole enlarging means and a drive assembly;

(b) rotating the apparatus to drill a pilot hole through the hydrocarbonaceous fluid producing zone;

(c) expanding the initially retracted pilot hole enlarging means upon exceeding the first pre-determined depth;

(d) enlarging the pilot hole to a diameter larger than the pilot hole and sufficient for gravel packing;

(e) continuing steps (b)-(d) until the first end of the slotted liner reaches a second pre-determined depth, the second pre-determined depth sufficient to place the slotted liner within the hydrocarbonaceous fluid producing zone; and (f) injecting a gravel slurry into an annulus defined by the enlarged hole and slotted liner to gravel pack the annulus.

2. The process of claim 1, further comprising the step circulating drilling fluid through the pipe string.

3. The process of claim 2, wherein the drilling fluid is selected from a group consisting of an aqueous-based polymeric solution, filtered water and a stable preformed foam.

4. The process of claim 1, wherein the housing of the apparatus lowered into the well bore in step (b) has a longitudinal bore therethrough.

5. The process of claim 4, wherein the apparatus lowered into the well bore in step (b) includes a piston axially movable within the longitudinal bore of the housing in response to a force applied thereto.

6. The process of claim 5, wherein the means for enlarging the pilot hole to a diameter larger than the pilot hole and sufficient for gravel packing includes at least one underreaming drag blade.

7. The process of claim 6, wherein the apparatus lowered into the well bore in step (b) further includes means connected to the at least one underreaming blade responsive to the downward movement of the piston within the longitudinal bore of the housing, the piston responsive means cooperating with the piston to effect the pivoting of the at least one underreaming blade from the initially retracted position to the expanded position for underreaming.

8. The process of claim 7, wherein the at least one underreaming drag blade is faced with a higher strength material selected from the group including a diamond material and a hardened metal.

9. The process of claim 5, wherein the means for enlarging the pilot hole to a diameter larger than the pilot hole and sufficient for gravel packing includes at least one roller-cone type underreaming bit.

10. The process of claim 9, wherein the apparatus lowered into the well bore in step (b) further includes means connected to the at least one underreaming bit responsive to the downward movement of the piston within the longitudinal bore of the housing, the piston responsive means cooperating with the piston to effect the pivoting of the at least one underreaming bit from the initially retracted position to the expanded position for underreaming.

11. An apparatus for drilling and installing a slotted liner and gravel packing the liner in a single trip into a well, comprising:

(a) a drill bit for drilling a pilot hole;

(b) a housing mounted above said pilot hole drill bit;

(c) means for enlarging a pilot hole, said pilot hole enlarging means pivotally mounted within said housing and capable of pivoting between an initially retracted position to an expanded position for enlarging a pilot hole to a diameter larger than the pilot hole and sufficient for gravel packing;

(d) a slotted liner having a first end and a second end, the first end joined to the apparatus above said housing; and (e) a drive assembly joined to the second end of the slotted liner.

12. The apparatus of claim 11, wherein said housing has a longitudinal bore therethrough.

13. The apparatus of claim 12, wherein said means for enlarging the pilot hole to a diameter larger than the pilot hole and sufficient for gravel packing includes at least one underreaming drag blade.

14. The apparatus of claim 13, further comprising means connected to said at least one underreaming blade responsive to hydraulic pressure to effect the pivoting of said at least one underreaming blade from said initially retracted position to said expanded position for underreaming.

15. The apparatus of claim 13, further comprising a piston axially movable within said longitudinal bore of said housing in response to a force applied thereto.

16. The apparatus of claim 15, further comprising means connected to said at least one underreaming blade responsive to the downward movement of said piston within said longitudinal bore of said housing, said piston responsive means cooperating with said piston to effect the pivoting of said at least one underreaming blade from said initially retracted position to said expanded position for underreaming.

17. The apparatus of claim 12, wherein said means for enlarging the pilot hole to a diameter larger than the pilot hole and sufficient for gravel packing includes at least one roller-cone type underreaming bit.

18. The apparatus of claim 17, further comprising means connected to said at least one underreaming bit responsive to hydraulic pressure to effect the pivoting of said at least one underreaming bit from said initially retracted position to said expanded position for underreaming.

19. The apparatus of claim 17, further comprising a piston axially movable within said longitudinal bore of said housing in response to a force applied thereto.

20. The apparatus of claim 19, further comprising means connected to said at least one underreaming bit responsive to the downward movement of said piston within said longitudinal bore of said housing, said piston responsive means cooperating with said piston to effect the pivoting of said at least one underreaming bit from said initially retracted position to said expanded position for underreaming.

* * * * *